US010729941B2

(12) United States Patent
Park et al.

(10) Patent No.: US 10,729,941 B2
(45) Date of Patent: Aug. 4, 2020

(54) BILLIARD BALL FOR TRAINING

(71) Applicant: Do Joon Park, Namyangju-si (KR)

(72) Inventors: Do Joon Park, Namyangju-si (KR); Ki Chang Park, Namyangju-si (KR)

(73) Assignee: Do Joon Park, Namyangju-si (KR)

( * ) Notice: Subject to any disclaimer, the term of this patent is extended or adjusted under 35 U.S.C. 154(b) by 0 days.

(21) Appl. No.: 16/472,993

(22) PCT Filed: Apr. 7, 2017

(86) PCT No.: PCT/KR2017/003795
§ 371 (c)(1),
(2) Date: Jun. 24, 2019

(87) PCT Pub. No.: WO2018/131751
PCT Pub. Date: Jul. 19, 2018

(65) Prior Publication Data

US 2020/0086179 A1 Mar. 19, 2020

(30) Foreign Application Priority Data

Jan. 11, 2017 (KR) ..... 10-2017-0003997

(51) Int. Cl.
*A63D 15/00* (2006.01)
*A63B 37/14* (2006.01)
*A63B 43/00* (2006.01)

(52) U.S. Cl.
CPC ..... *A63B 37/14* (2013.01); *A63B 43/002* (2013.01); *A63B 2243/002* (2013.01)

(58) Field of Classification Search
CPC ..... A63D 15/00; A63D 15/006; A63B 43/00; A63B 43/002; A63B 43/008;
(Continued)

(56) References Cited

U.S. PATENT DOCUMENTS 2,002,631 A * 5/1935 Fiondella ..... A63F 9/0252 473/615
2,151,030 A * 3/1939 Hinsen ..... A63B 43/002 473/569
(Continued)

FOREIGN PATENT DOCUMENTS

JP 2002-011118 A 1/2002
JP 2006-087732 A 4/2006
(Continued)

OTHER PUBLICATIONS

International Search Report dated Sep. 19, 2017 in counterpart International Patent Application No. PCT/KR2017/003795 (2 pages in English, 2 pages in Korean).

*Primary Examiner* — Mitra Aryanpour
(74) *Attorney, Agent, or Firm* — NSIP Law

(57) ABSTRACT

The present invention relates to two integrated billiard balls for training, which include an image ball and an object ball assembled together by a connecting means and integrated through spherical contact therebetween so that, at the time of billiard training, a trainee can figure out a situation in which the trainee can hit the object ball coupled to the image ball of the training billiard balls, with a predetermined thickness, just by accurately hitting a cue ball while aiming the center of the image ball. Therefore, the present invention enables a trainee to easily practice thickness adjustment of an object ball and thus improve his or her billiard capability.

7 Claims, 13 Drawing Sheets

(58) Field of Classification Search
CPC ..... A63B 69/0002; A63B 69/002; A63B 69/3688; A63B 37/14; A63B 2243/002
USPC ..... 473/2, 4, 52, 53, 1, 280, 200, 451, 422, 473/247; D21/707–714
See application file for complete search history.

(56) References Cited

U.S. PATENT DOCUMENTS 3,184,234 A * 5/1965 Struble ..... A63B 23/14 482/46
3,357,705 A * 12/1967 Blanchard ..... A63B 43/00 473/280
3,711,091 A * 1/1973 Dixon ..... A63D 15/006 473/2
3,918,720 A * 11/1975 Gordos ..... A63B 69/3688 473/200
4,153,248 A * 5/1979 Holmes ..... A63B 37/10 473/595
4,411,431 A * 10/1983 Judice ..... A63B 69/3688 473/200
5,595,546 A * 1/1997 Masters ..... A63B 69/3688 473/280
5,743,808 A * 4/1998 Barth ..... A63B 43/002 473/280
5,820,495 A * 10/1998 Howland ..... A63B 69/0002 473/451
5,885,165 A * 3/1999 Krause ..... A63B 69/3688 473/200
6,093,118 A * 7/2000 Simpson ..... A63B 69/0002 434/247
6,471,606 B1 * 10/2002 Simpson ..... A63B 69/0002 473/451
6,729,969 B2 * 5/2004 Fox ..... A63B 69/3688 473/280
6,860,816 B2 * 3/2005 Bond ..... A63D 15/006 473/2
7,247,106 B1 * 7/2007 Brandt ..... A63B 43/00 473/422
D655,358 S * 3/2012 Barrett ..... D21/708
8,523,693 B2 * 9/2013 Nelson ..... A63D 15/006 473/2
9,907,720 B2 * 3/2018 Kuhne ..... A63B 23/0233 482/79
2009/0233725 A1 * 9/2009 Stuart ..... A63D 15/105 473/2

FOREIGN PATENT DOCUMENTS

JP 2010-279659 A 12/2010
KR 10-0642525 B1 11/2006
KR 20-2011-0003785 U 4/2011

* cited by examiner

BILLIARD BALL FOR TRAINING

TECHNICAL FIELD

The present disclosure relates to training billiard balls used in aiming training, in which a trainee attempts to deliver a cue ball to a contact point of an object ball by hitting the cue ball with a cue stick. More particularly, two training billiard balls comprised of an image ball and an object ball are fitted together with a connector, such that the two training balls are integrated with each other while being in spherical contact with each other. The two training billiard balls allow a trainee to become accustomed to delivering a cue ball to a contact point on the object ball by accurately aiming at the center of the image ball and delivering the cue ball to the center of the image ball. In this manner, the trainee can easily and simply practice delivering the cue ball to the contact point on the object ball, so as to improve his or her skill.

BACKGROUND ART

Billiards are leisure sports played on a billiards table to score points by hitting red and white balls using a cue stick. Billiards are generally categorized as four-ball billiards, carom billiards, pool, and the like. Four-ball billiards is played using two red balls and two white balls, while carom billiards is played using a single red ball and two white balls.

According to the terms used in billiards, a ball hit with a cue stick by a player is referred to as a "cue ball," a first ball contacted by the cue ball is referred to as a "first object ball," and a second ball contacted by the cue ball is referred to as a "second object ball."

Billiards requires a process of delivering a cue ball to hit a predetermined point of a first object ball. Here, hitting the predetermined point of the first object ball with the cue requires aiming the cue ball such that a portion of the cue ball overlaps a predetermined portion of the object ball. The overlapping portions may be referred to as ½, ⅓, ¼, ⅕, ⅙, etc. These numbers also indicate portions of the diameter of the object ball relevant to points on the object ball contacted by the cue ball.

When playing a billiard game or practicing billiards, a cue ball is hit with a cue stick to contact a predetermined point on a first object ball. Here, it is necessary to aim the tip of the cue stick at a specific point. However, the point, to which the tip of the cue stick is to be directed, may be obscured and is unfixed, and thus, it may be difficult for a novice to aim.

That is, although billiard experts advise novices to perform the aiming on the basis of conceptual and numerical bases, it is impossible to determine a point of the object ball on which the tip of the cue stick is to be aimed. When delivering a cue ball to an object ball, it is essentially important to accurately aim the cue ball to hit an intended point on the object ball in order to improve billiard skills. Regardless of such necessity, no related-art solutions, by which aiming at an intended point on the object ball can be trained, have been found.

In this regard, Korean Utility Mode Application Publication No. 20-2011-0003785 disclosed "BILLIARD BALL COURSE TRAINING TOOL." According to this document, a training tool provided with an object ball (e.g. a first object ball) is placed on a predetermined location of a billiard table. In this position, a cue ball (or impact ball) is hit with a cue stick to be delivered to the object ball (or a target ball). After contacting the object ball, the cue ball moves around the table. In this manner, a trainee can train to deliver the cue ball along an intended course on the table.

Accordingly there has been demand for the development of a new solution, by which a person can easily practice aiming the cue ball at the object ball, such that a portion of the cue ball overlaps a portion of the object ball, in order to improve his or her billiard skills.

DISCLOSURE

Technical Problem

Accordingly, the present disclosure has been made in consideration of the fact that a portion of an object ball, which a cue ball is intended to contact when delivered with a cue stick, is in the direction in which the cue ball rolls. The present disclosure proposes training billiard balls in which an image ball and an object ball are attached to each other, allowing a trainee to practice delivering a cue ball to an intended point on the object ball by aiming at the center of the image ball, attached to the object ball and located in front of the object ball, and delivering the cut ball to the center of the image ball by hitting the cue ball with a cue stick.

Technical Solution

According to an aspect of the present disclosure, provided are training billiard balls.

The training billiard balls according to an embodiment may include: an image ball and an object ball; and a connector causing the image ball and the object ball to be fitted and integrated together by spherical contact.

The connector may include threads provided in holes provided in the image ball and the object ball, extending in a direction from a spherical surface to the center of each of the image ball and the object ball, and a threaded-connecting rod engaged with the threads of the holes.

The connector may include holes provided in the image ball and the object ball, extending in a direction from a spherical surface to the center of each of the image ball and the object ball, and a connecting rod press-fitted into the holes.

The connector may include threads provided in holes provided in the image ball and the object ball, extending in a direction from a spherical surface to the center of each of the image ball and the object ball, connector sockets engaged with the threads of the holes, and an elastic restoring member disposed in the connector sockets.

The connector may include magnets embedded in holes provided in the image ball and the object ball, extending in a direction from a spherical surface to the center of each of the image ball and the object ball, such that the image ball and the object ball are attached to and detached from each other due to magnetic force.

A plurality of equally-spaced rings may be marked on a hemispherical portion of the object ball, adjacent to the image ball, so as to appear as stripes, by which portions of the object ball overlapped by the image ball are estimated.

A plurality of equally-spaced rings may be marked on hemispherical portions of the object ball and the image ball, adjacent to each other, so as to appear as stripes, by which portions of the object ball and the image ball overlapped by each other are estimated.

The training billiard balls may have the same size as billiard balls used in games.

Advantageous Effects

According to the training billiard balls according to the present disclosure, a trainee can practice delivering a cue ball to a contact point of an object ball by accurately aiming at the center of the image ball and delivering the cue ball to the center of the image ball.

In addition, the present disclosure is significantly effect in practicing a feather shot, i.e. delivering a cue ball to contact a narrow portion of an object ball. If a relatively-wider portion of the image ball of the training billiard balls is contacted, the object ball attached to the image ball may move, and thus, cannot be contacted by the cue ball. Thus, it is required to delver the cue ball to contact a significantly-narrow portion of the image ball so as to minimize the movement of the object ball, so that the cue ball can contact the object ball. In this manner, the present disclosure is significantly helpful for training to deliver the cue ball to a significantly-narrow portion of the object ball 31. Accordingly, the trainee can more easily deliver a cue ball to an intended point in real games.

In addition, the present disclosure is suitable for practicing a gather shot or a nurse short, in which two object balls are continuously brought closer to each other while being contacted by a cue ball in a four-ball billiards game. Since the image ball and the object ball are attached to each other, the balls are not scattered when contacted by the cue ball, thereby reducing the labor of the trainee to bring the balls together. In addition, since only the direction of the training billiard balls is changed, it is possible to practice the nurse short in a variety of directions.

In addition, the present disclosure is suitable for practicing a rail-first shot in which a cue ball contacts first and second object balls after hitting three or more rail cushions, in particular, when two balls are close to each other. In this case, when the training billiard balls 11 according to the present disclosure are used, training can be convenient, since the two balls are not scattered.

In addition, practice moving the cue stick along a line, i.e. stroke practice, can be performed. For example, in a case in which the cue ball is delivered toward the center of the training billiard balls (i.e. the point of contact of the image ball and the object ball), when the cue ball simultaneously contacts the two training billiard balls, the training billiard balls roll in the same direction, thereby indicating that the stroke was proper. When the cue ball contacts the image ball or the object ball first, one of the two balls moves further, and thus, the training billiard balls turns. The trainee can find unbalance in the stroke by observing such movement. This is helpful for the stroke practice.

DESCRIPTION OF DRAWINGS

FIGS. 5 to 7 illustrate other modified embodiments of the connector, in which FIG. 5 is a disassembled cross-sectional view illustrating the connector, FIG. 6 is an assembled cross-sectional view, and FIG. 7 is a plan view illustrating a position in which an elastic restoring member of the connector is stretched;

FIGS. 11 and 12 illustrate an application of the training billiard balls according to the present disclosure, in which FIG. 11 illustrates a position in which a relatively-narrower portion of the object ball is overlapped by the image ball, and FIG. 12 illustrates a position in which a relatively-wider portion of the object ball is overlapped by the image ball.

MODE FOR INVENTION

Hereinafter, specific embodiments of the present disclosure will be described with reference to the drawings. The following descriptions and the drawings shall be interpreted as being illustrative for a better understanding of the spirit of the present disclosure while not being limitative of the scope of the present disclosure. In other words, the following embodiments may be modified in a variety of manners when used in fields, and such modifications thereof within the spirit of the present disclosure shall be regarded as being within the scope of the present disclosure. The following description will fully convey the spirit of the present disclosure to a person having ordinary skill in the art.

As will be described in detail with reference to the drawings, the present disclosure provides training billiard balls according to a variety of embodiments.

Figure 1:
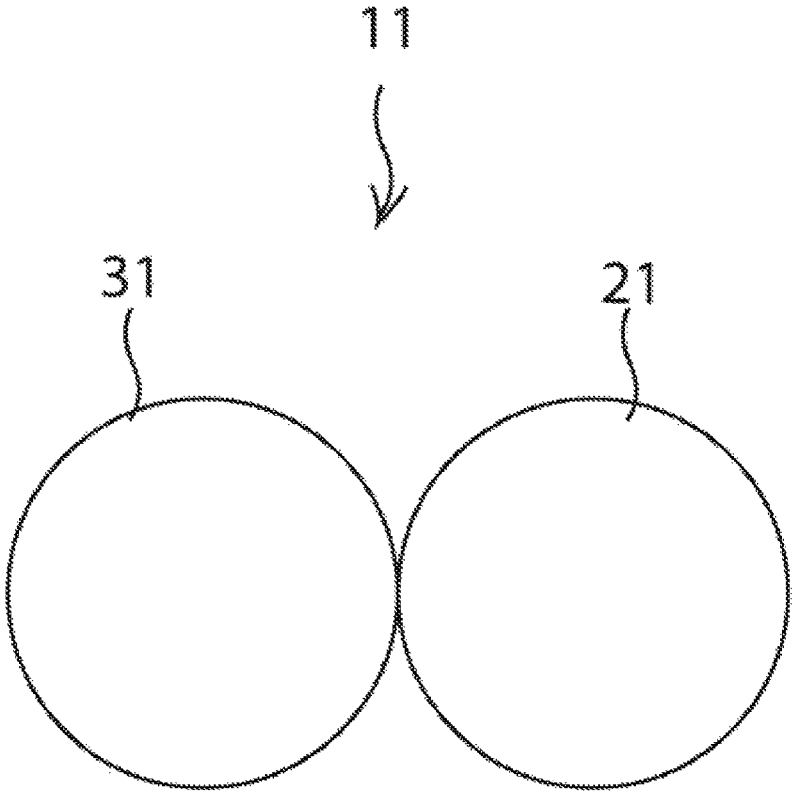
FIG. 1 is a plan view illustrating an assembly of training billiard balls according to a first embodiment of the present disclosure.
Figure 2:
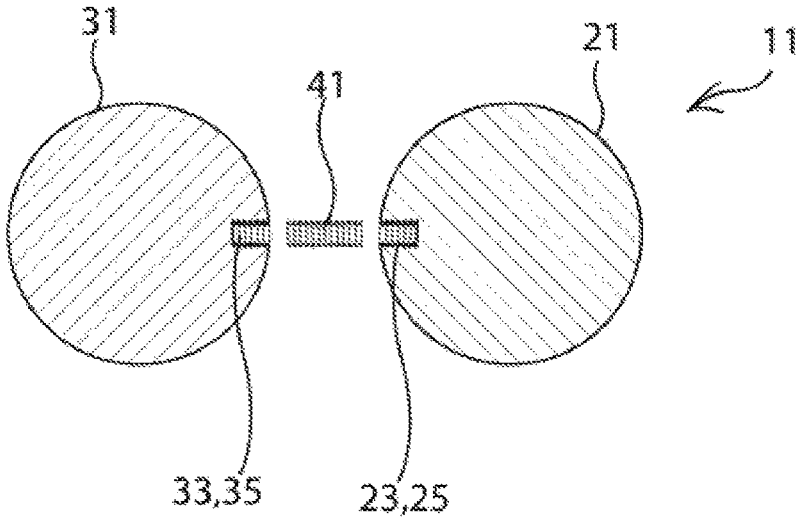
FIG. 2 is a disassembled cross-sectional view illustrating a connector.
Figure 3:
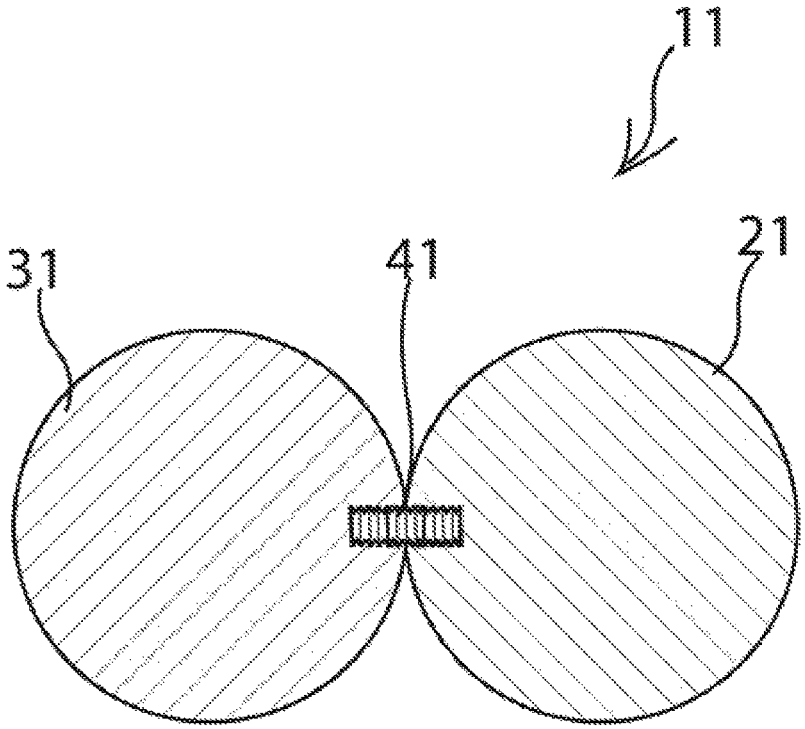
FIG. 3 is an assembled cross-sectional view of FIG. 2.

FIG. 1 is a plan view illustrating an assembly of training billiard balls according to a first embodiment of the present disclosure, FIG. 2 is a disassembled cross-sectional view illustrating a connector, while FIG. 3 is an assembled cross-sectional view of FIG. 2.

As illustrated in FIGS. 1 to 3, the training billiard balls 11 according to a first embodiment of the present disclosure include an image ball 21 and an object ball 31.

The two training billiard balls 11, including the image ball 21 and the object ball 31, are fitted together using a connector. The two training balls 11 are integrated with each other while being in spherical contact with each other.

As illustrated in FIGS. 2 and 3, the connector includes holes 23 and 33 provided in the image ball 21 and the object ball 31, extending in the direction from the spherical surface to the center of each ball, with threads 25 and 35 being provided in the holes 23 and 33. A threaded connecting rod 41 is engaged with the threads 25 and 35, such that the two training billiard balls 11 are integrated with each other while being in spherical contact with each other.

Figure 4:
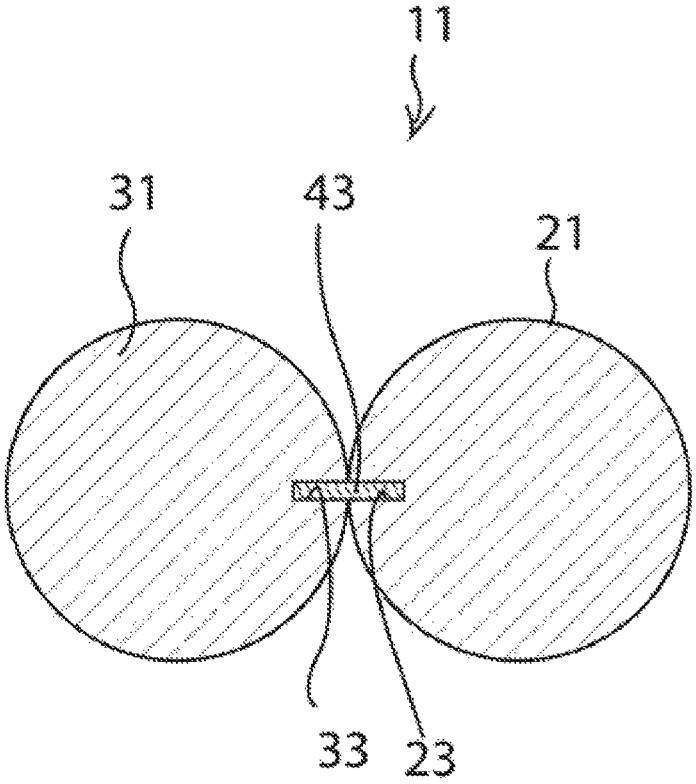
FIG. 4 illustrates a modified embodiment of the connector illustrated in FIG. 3.

In addition, FIG. 4 illustrates a modified embodiment of the connector illustrated in FIG. 3, in which the holes 23 and 33 are provided in the image ball 21 and the object ball 31, extending in the direction from the spherical surface to the center. A connecting rod 43 is press-fitted into the holes 23 and 33, such that the two training billiard balls 11 are integrated with each other while being in spherical contact with each other.

The connecting rods 41 and 43 may be made of a synthetic resin or a metal having high impact resistance.

Figure 5:
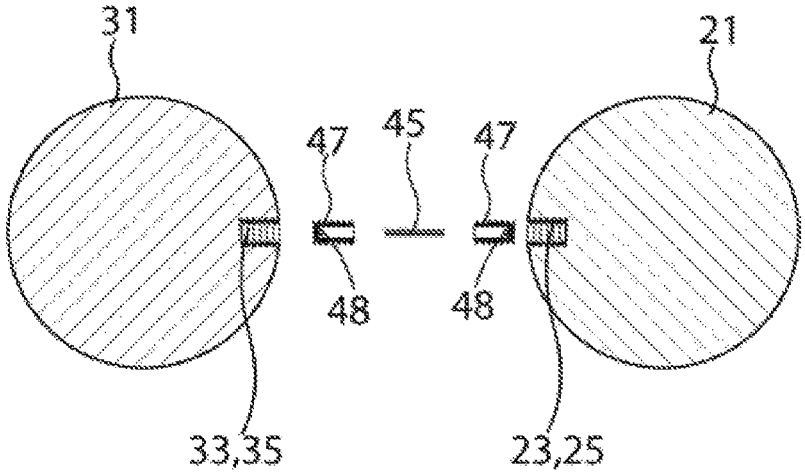
Figure 6:
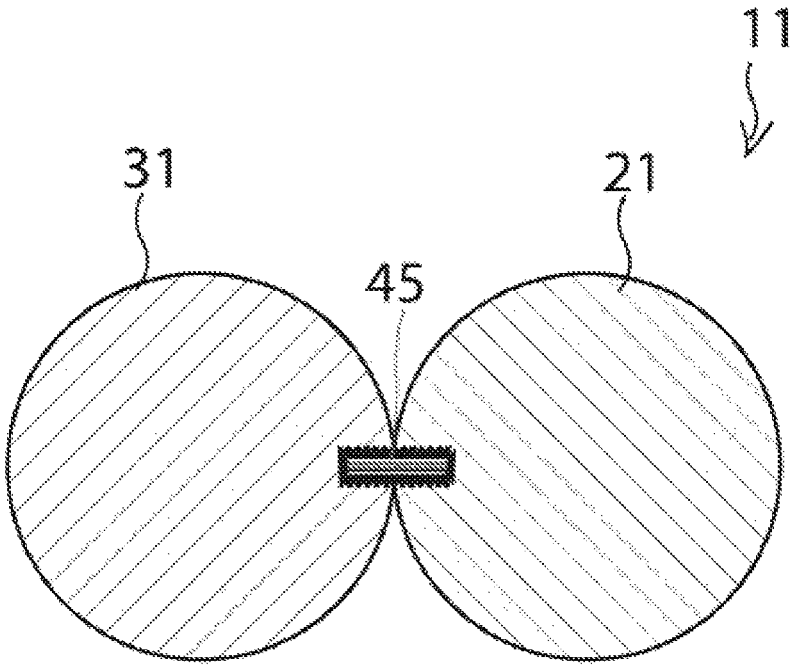
Figure 7:
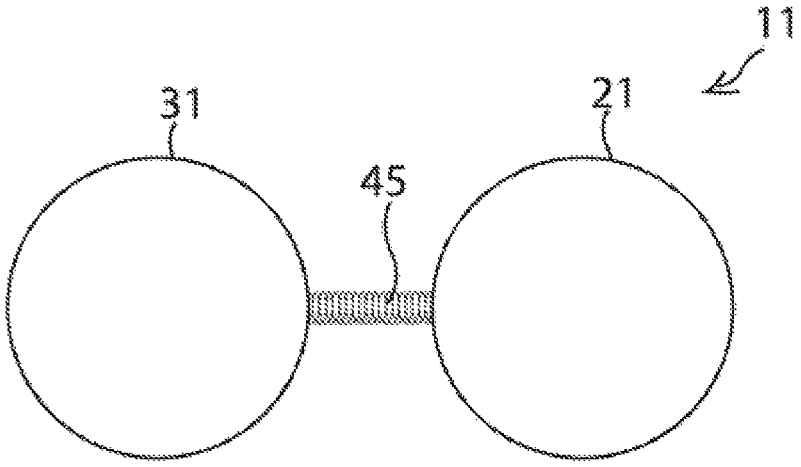

FIGS. 5 to 7 illustrate other modified embodiments of the connector. FIG. 5 is a disassembled cross-sectional view illustrating the connector, FIG. 6 is an assembled cross-sectional view, and FIG. 7 is a plan view illustrating a position in which an elastic restoring member of the connector is stretched.

In the connector, the threads 25 and 35 are formed in the holes 23 and 33 provided in the image ball 21 and the object ball 31, extending the direction from the spherical surface to the center, and connector sockets 47 are screw-engaged with the holes 23 and 33 via the threads 25 and 35. In addition, an elastic restoring member 45 disposed in the connector sockets 47.

The elastic restoring member 45 may be implemented as a spring or a rubber string having elastic restoring force. In FIG. 5, the elastic restoring member 45 is illustrated as being a spring, with both ends thereof being connected to hooks 48 within the connector sockets 47.

Figure 8:
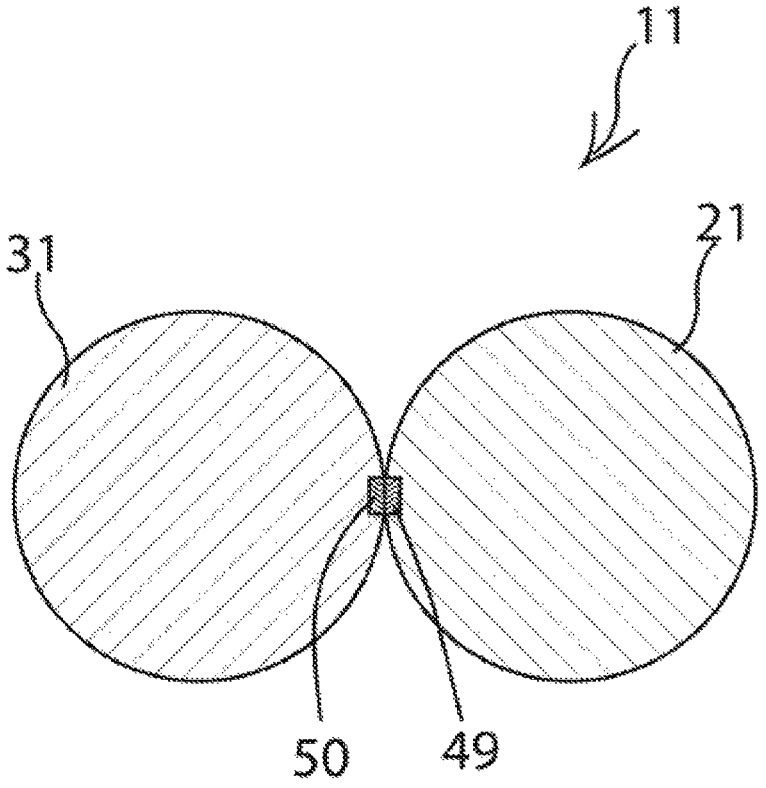
FIG. 8 is an assembled cross-sectional view illustrating another modified embodiment of the connector.

FIG. 8 is an assembled cross-sectional view illustrating another modified embodiment of the connector.

In the connector illustrated in FIG. 8, magnets 49 and 50 are embedded in holes provided in the image ball 21 and the object ball 31, extending in the direction from the spherical surface to the center, such that the image ball 21 and the object ball 31 can be attached to and detached from each other due to magnetic force.

As described above, the image ball 21 and the object ball 31 can be attached to and detached from each other via the magnets 49 and 50. Here, the magnets 49 and 50 may be provided with strong magnetic force, such that, even when a cue ball hit by a cue stick contacts the image ball 21, the image ball 21 and the object ball 31 can remain attached to each other instead of being separated.

Figure 9:
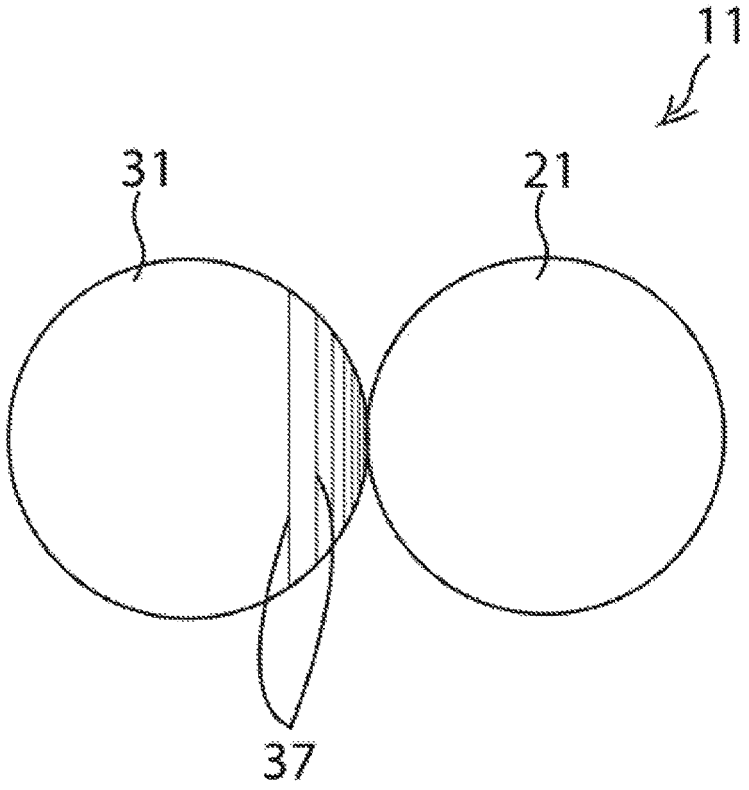
FIG. 9 is a plan view illustrating a modified embodiment of the training billiard balls illustrated in FIG. 1.

In addition, as illustrated in FIG. 9, a plurality of equally-spaced rings 37 are marked on the object ball 31 of the training billiard balls 11. The equally-spaced rings 37 are marked on a hemispherical portion of the object ball adjacent to the image ball 21, so as to appear as stripes in FIG. 9, by which portions of the object ball 31 overlapped by the image ball 21 can be estimated.

Figure 10:
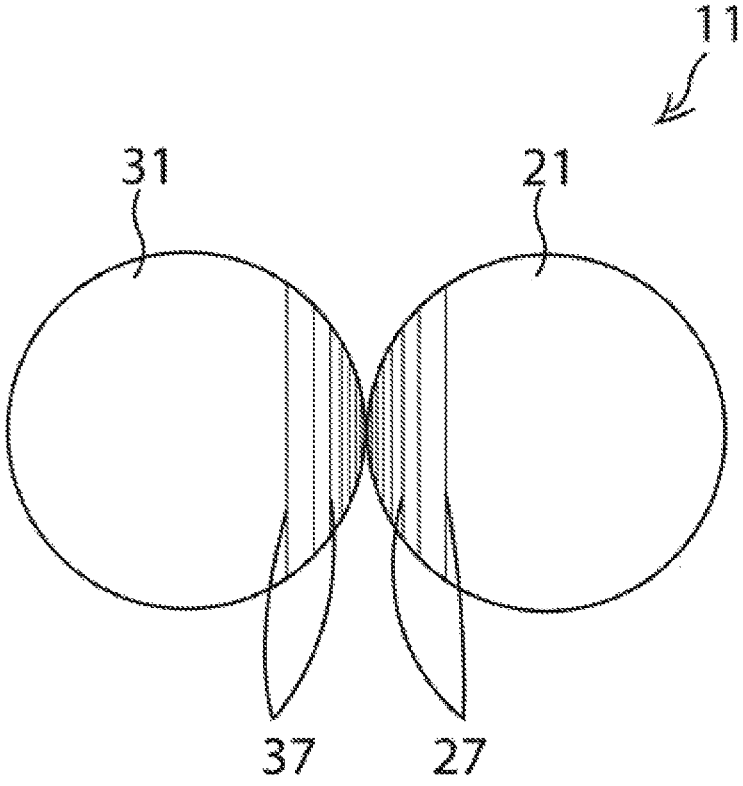
FIG. 10 is a plan view illustrating a modified embodiment of the training billiard balls illustrated in FIG. 9.

In addition, as illustrated in FIG. 10, a plurality of equally-spaced rings 37 and 27 are marked on the object ball 31 and the image ball 21 of the training billiard balls 11. The equally-spaced rings 37 and 27 are marked on hemispherical portions of the object ball 31 and the image ball 21, adjacent to each other, so as to appear as stripes in FIG. 10, by which portions thereof overlapped by each other can be estimated.

The stripe-appearing equally-spaced rings 37 and 27 may be realized by forming shallow grooves in the object ball 31 and the image ball 21 and then filling the grooves with material having a color different from those of the balls, such that the colored portions are coplanar with the spherical surface of the object ball 31 and the image ball 21 without protruding from the surfaces of the balls.

The training billiard balls 11 may be made of a synthetic material, the same as or equivalent to the commonly-known material of billiard balls used games.

The training billiard balls 11 may have the same size as that of billiard balls used in games, so that skills learned in training can be directly applied to games.

Figure 11:
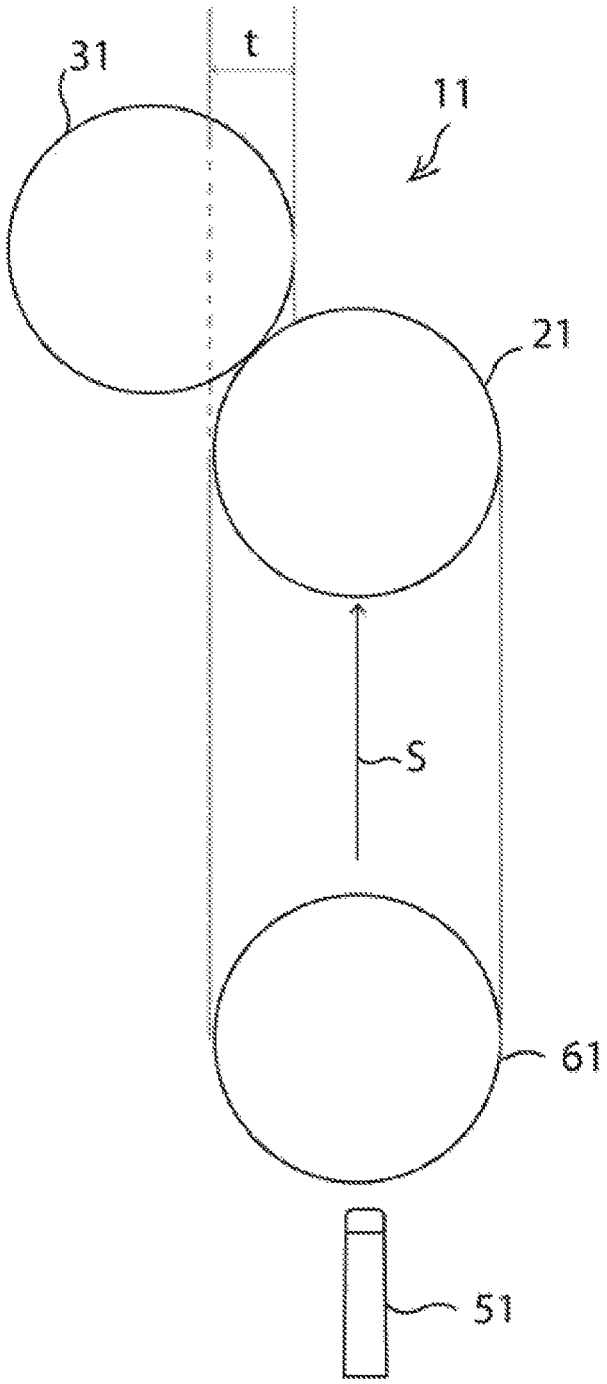
Figure 12:
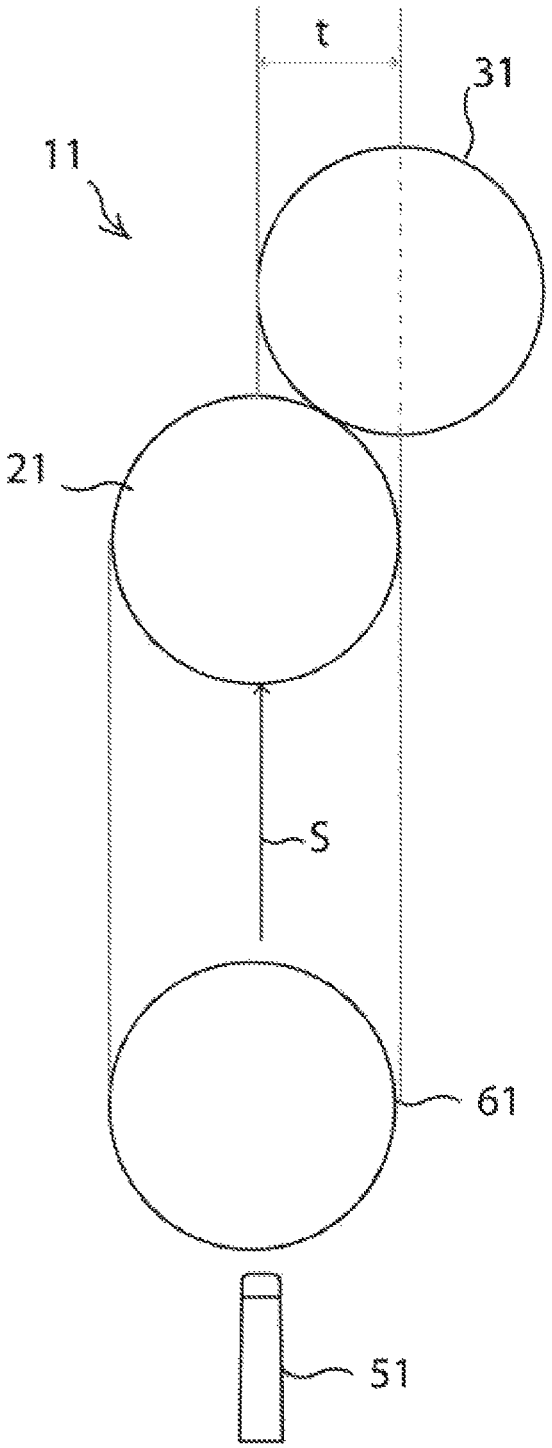

FIGS. 11 and 12 illustrate an application of the training billiard balls according to the present disclosure. FIG. 11 illustrates a position in which the object ball is arranged with respect to the cue ball such that a relatively-narrower (or thinner) portion of the object ball is overlapped by the image ball, i.e. the object ball is arranged to be narrow (or thin) with respect to the cue ball, while FIG. 12 illustrates a position in which the object ball is arranged with respect to the cue ball such that a relatively-wider (or thicker) portion of the object ball is overlapped by the image ball, i.e. the object ball is arranged to be wide (or thick) with respect to the cue.

As illustrated in FIGS. 11 and 12, at the time of billiard training, a trainee can practice adjusting the width t of an overlapping portion of the object ball 31 by merely hitting a cue ball 61 with a cue stick 51 by aiming at the image ball 21 so as to accurately deliver the cue ball 61 to the center of the image ball 21 (indicated with an arrow S).

Specifically, the training billiard balls 11 are located on any location of a billiard table. Here, as illustrated in FIGS. 11 and 12, the training billiard balls 11 may be arranged such that the width t of the overlapping portion of the object ball 31 is relatively-thin or thick with respect to the cue ball 61.

In this position, a trainee performs aiming by determining the line of the cue stick 51 necessary to deliver the cue ball 61 to the center of the image ball 21 (indicated with the arrow S). In this position, when the object ball 31, attached to and located behind the image ball 21, is viewed from the cue ball 61, the width t of the overlapping portion of the object ball 31 can be determined. Afterwards, the cue ball 61 is hit with the cue stick toward the center of the image ball 21, as indicated with the arrow S. Although the cue ball 61 does not directly contact the object ball 31, it may be regarded that the width t of the overlapping portion of the object ball 31 has been determined, since the cue ball 61 has contacted the center of the image ball 21, as indicated with the arrow S. Thus, the training of delivering the cue ball to a position overlapping an intended portion of the object ball 31 can be assisted and accomplished by delivering the cue ball to the center of the image ball 21.

As illustrated in FIG. 9, since the equally-spaced rings 37 are marked on the object ball 31, the equally-spaced rings 37 allow a trainee to easily determine the width of a portion of the object ball 31 overlapped by the cue ball 61 when delivering the cue ball 61 to the image ball 21. As illustrated in FIG. 10, since the equally-spaced rings 37 and 27 are marked on the object ball 31 and the image ball 21, the rings allow a trainee to easily determine the width of an overlapping portion when delivering the cue ball 61 to the object ball 31 or the image ball 21.

In addition, the present disclosure allows a trainee to practice a feather shot, i.e. delivering the cue ball 61 to a narrow portion of the training billiard balls 11. If a relatively-wider portion of the image ball 21 of the training billiard balls 11 is contacted, the object ball 31 attached to the image ball 21 may move, and thus, cannot be contacted by the cue ball. Thus, it is required to deliver the cue ball to contact a significantly-narrow portion of the image ball 21 so as to minimize the movement of the object ball 31, so that the cue ball can contact the object ball 31. Accordingly, the present disclosure is significantly helpful for training to deliver the cue ball to a significantly-narrow portion of the object ball 31.

In a case in which the elastic restoring member 45 is used as the connector illustrated in FIGS. 5 to 7, when the cue ball 61 contacts the image ball 21, the impact is transferred to the object ball 31. Then, the elastic restoring member 45 allows the image ball 21 and the object ball 31 to be instantaneously separated from each other and then return to the original spherical-contact position.

In addition, the present disclosure is suitable for practicing a gather shot or a nurse short, in which two object balls are continuously brought closer to each other while being contacted by a cue ball in a four-ball billiards game. Since the image ball 21 and the object ball 31 are attached to each other, the balls are not scattered when contacted by the cue ball 61, thereby reducing the labor of the trainee to bring the balls together. In addition, since only the direction of the training billiard balls 11 is changed, it is possible to practice the nurse short in a variety of directions.

In addition, the present disclosure is suitable for practicing a rail-first shot in which a cue ball contacts first and second object balls after hitting three or more rail cushions, in particular, when two balls are close to each other. In this case, when the training billiard balls 11 according to the present disclosure are used, training can be convenient, since the two balls are not scattered.

Figure 13:
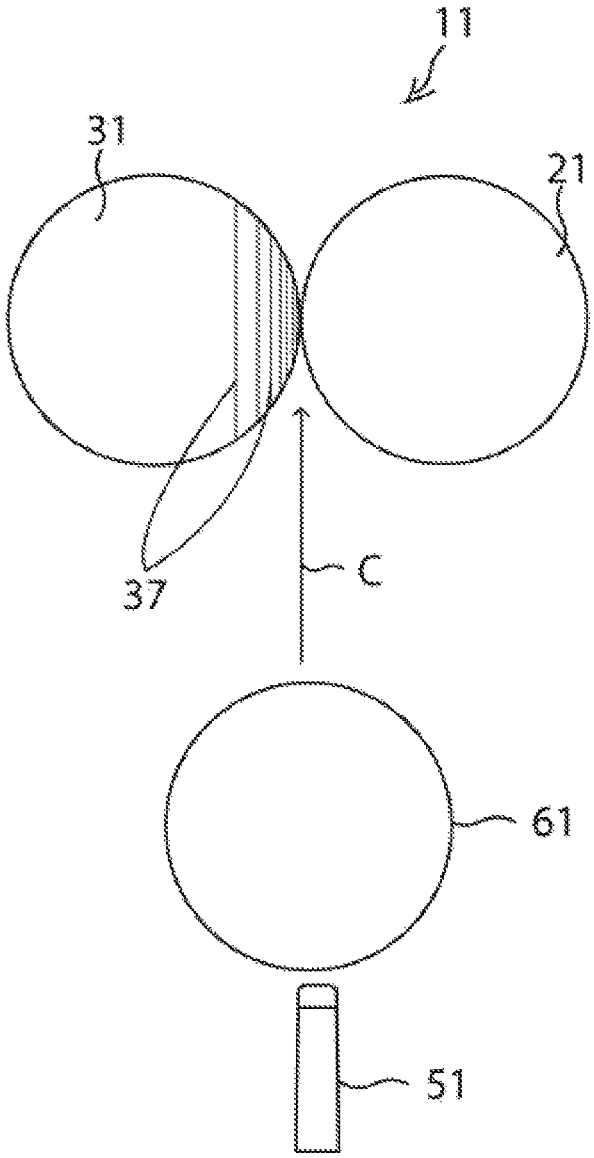
FIG. 13 illustrates another application of the training billiard balls according to the present disclosure.

In addition, practice moving the cue stick along a line, i.e. stroke practice, can be performed. For example, as illustrated in FIG. 13, the cue ball 61 may be delivered toward the center of the training billiard balls 11 (i.e. the point of contact of the image ball and the object ball), as indicated with an arrow C. When the cue ball 61 simultaneously contacts the two training billiard balls, the training billiard balls roll in the same direction, thereby indicating that the stroke was proper. When the cue ball 61 contacts the image ball 21 or the object ball 31 first, one of the two balls moves further, and thus, the training billiard balls turn. The trainee can find unbalance in the stroke by observing such movement. This is helpful for the stroke practice.

Although the exemplary embodiments of the present disclosure have been described for illustrative purposes, those skilled in the art will appreciate that various modifications, additions and substitutions are possible, without departing from the scope and spirit of the present disclosure as disclosed in the accompanying claims.

The invention claimed is:

1. Training billiard balls comprising:

an image ball and an object ball; and a connector causing the image ball and the object ball to contact each other in a first position by spherical contact, wherein the connector comprises:

threads provided in holes provided in the image ball and the object ball, extending in a direction from a spherical surface to the center of each of the image ball and the object ball;

connector sockets engaged with the threads of the holes; and an elastic restoring member disposed in the connector sockets, wherein, when an external force is applied to the image ball, the image ball and the object ball are in a second position where the image ball and the object ball are separated from each other, and wherein the elastic restoring member is enclosed by the connector sockets when the image ball and the object ball are in the first position.

2. The training billiard balls according to claim 1, wherein a plurality of equally-spaced rings are marked on a hemispherical portion of the object ball, adjacent to the image ball, so as to appear as stripes, by which portions of the object ball overlapped by the image ball are estimated.

3. The training billiard balls according to claim 1, wherein a plurality of equally-spaced rings are marked on hemispherical portions of the object ball and the image ball, adjacent to each other, so as to appear as stripes, by which portions of the object ball and the image ball overlapped by each other are estimated.

4. The training billiard balls according to claim 1, wherein the sizes of the training billiard balls are the same as those of billiard balls used in games.

5. The training billiard balls according to claim 1, wherein the elastic restoring member is a rubber string.

6. The training billiard balls according to claim 2, wherein the plurality of equally-spaced rings are coplanar with a spherical surface of the object ball.

7. The training billiard balls according to claim 3, wherein the plurality of equally-spaced rings on the object ball are coplanar with a spherical surface of the object ball and the plurality of equally-spaced rings on the image ball are coplanar with a spherical surface of the image ball.

* * * * *